US006102399A

United States Patent [19]

Kifer

[11] Patent Number: 6,102,399

[45] Date of Patent: Aug. 15, 2000

[54] FOUR WAY CHESS GAME

[76] Inventor: Lawrence Kifer, 3698 Centennial Trail, Duluth, Ga. 30130

[21] Appl. No.: 08/792,923

[22] Filed: Jan. 21, 1997

[51] Int. Cl.[7] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| D. 134,538 | 12/1942 | Fielding | 273/261 |
| 511,773 | 1/1894 | Higgins | 273/261 |
| 1,555,937 | 10/1925 | Billman | 273/261 |
| 2,614,842 | 10/1952 | Rice | 273/261 |
| 3,843,130 | 10/1974 | Whitney | 273/261 |
| 4,147,360 | 4/1979 | Bailey | 273/261 |
| 4,708,349 | 11/1987 | Shomer | 273/261 |
| 4,932,669 | 6/1990 | Perry | 273/261 |
| 5,125,666 | 6/1992 | Adams | 273/261 |
| 5,193,813 | 3/1993 | Goff | 273/241 |
| 5,306,017 | 4/1994 | Huston | 273/261 |
| 5,492,332 | 2/1996 | Hessnice | 273/261 |

FOREIGN PATENT DOCUMENTS

| | | | |
|---|---|---|---|
| 2299886 | 10/1976 | France | 273/261 |
| 2649903 | 1/1991 | France | 273/261 |
| 3520047 | 12/1986 | Germany | 273/261 |
| 3818343 | 12/1989 | Germany | 273/261 |

*Primary Examiner*—William E. Stoll
*Attorney, Agent, or Firm*—Ralph E. Pope

[57] ABSTRACT

The present invention is chess game played by up to four players. The players may play against each other or in combination. The game consists of a standard set of chess game pieces controlled by standard chess rules. The standard chess game board is made wider by two rows and columns and 3×8 square appendages are added to each edge. The game may be played with two to four players. The players may be arranged in teams of two each.

4 Claims, 8 Drawing Sheets

110

112 alternating turns (112) by at least two players selected from a group consisting of first player, second player, third player, and fourth player, each player having a corresponding set of game pieces;

114 first using (114) a first set of game pieces by the first player, the first set of game pieces having an identification means, the first set of game pieces are arranged on a first appendage (12A) of the game board (12) proximal to the first player, the first set of game pieces consisting of ten first pawns (14F), initially positioned on a second proximal row of the first appendage (12A), positioning one first pawn (14F) per square, a first rook (14A) is initially positioned on a left proximal square in the first proximal row and first proximal column, a first knight (14B) is initially positioned on a proximal square in the first proximal row adjacent the first rook (14A), a first bishop (14C) is initially positioned on a proximal square in the first proximal row adjacent the first knight (14B), a first queen (14D) is initially positioned on a proximal square in the first proximal row adjacent the first bishop (14C), a first king (14E) initially positioned on a proximal square in the first proximal row adjacent the first queen (14D), a second first bishop (14C) is initially positioned on a proximal square in the first proximal row adjacent the first king (14E), a first knight (14B) is initially positioned on a proximal square in the first proximal row the second first bishop (14C), a left rook (14A) is initially positioned on a proximal square in the first proximal row adjacent the second first knight (14B);

116 second using (116) a second set of game pieces (16) by a second player, the second set of game pieces (16) having an identification means, the second set of game pieces (16) are arranged on a second appendage (12B) of the game board (12) proximal to the second player consisting of ten second pawn (16F) initially positioned on a second proximal row of the second appendage (12B), positioning one second pawn (16F) per square, a second rook (16A) is initially positioned on a left proximal square in the second proximal row and second proximal column, a second knight (16B) is initially positioned on a proximal square in the second proximal row adjacent the second rook (16A), a second bishop (16C) is initially positioned on a proximal square in the second proximal row adjacent the second knight (16B), a second queen (16D) is initially positioned on a proximal square in the second proximal row adjacent the second bishop (16C), a second king (16E) initially positioned on a proximal square in the second proximal row adjacent the second queen (16D), a second second bishop (16C) is initially positioned on a proximal square in the second proximal row adjacent the second king (16E), a second knight (16B) is initially positioned on a proximal square in the second proximal row the second second bishop (16C), a second rook (16A) is initially positioned on a proximal square in the second proximal row adjacent the second second knight (16B);

FIGURE 3

118 third using (118) a third set of game pieces (18) by a third player, the third set of game pieces (18) having an identification means, the third set of game pieces (18) are arranged on a s third appendage (12C) of the game board (12) proximal to the third player consisting of ten third pawn (18F) initially positioned on a third proximal row of the third appendage (12C), positioning one third pawn (18F) per square, a third rook (18A) is initially positioned on a left proximal square in the third proximal row and third proximal column, a third knight (18B) is initially positioned on a proximal square in the third proximal row adjacent the third rook (18A), a third bishop (18C) is initially positioned on a proximal square in the third proximal row adjacent the third knight (18B), a third queen (18D) is initially positioned on a proximal square in the third proximal row adjacent the third bishop (18C), a third king (18E) initially positioned on a proximal square in the third proximal row adjacent the third queen (18D), a second third bishop (18C) is initially positioned on a proximal square in the third proximal row adjacent the third king (18E), a third knight (18B) is initially positioned on a proximal square in the third proximal row the second third bishop (18C), a third rook (18A) is initially positioned on a proximal square in the third proximal row adjacent the second third knight (18B); and 120 fourth using (120) a fourth set of game pieces (20) by a fourth player, the fourth set of game pieces (20) having an identification means, the fourth set of game pieces (20) are arranged on a s fourth appendage (12D) of the game board (12) proximal to the fourth player consisting of ten fourth pawn (20F) initially positioned on a fourth proximal row of the fourth appendage (12D), positioning one fourth pawn (20F) per square, a fourth rook (20A) is initially positioned on a left proximal square in the fourth proximal row and fourth proximal column, a fourth knight (20B) is initially positioned on a proximal square in the fourth proximal row adjacent the fourth rook (20A), a fourth bishop (20C) is initially positioned on a proximal square in the fourth proximal row adjacent the fourth knight (20B), a fourth queen (20D) is initially positioned on a proximal square in the fourth proximal row adjacent the fourth bishop (20C), a fourth king (20E) initially positioned on a proximal square in the fourth proximal row adjacent the fourth queen (20D), a second fourth bishop (20C) is initially positioned on a proximal square in the fourth proximal row adjacent the fourth king (20E), a fourth knight (20B) is initially positioned on a proximal square in the fourth proximal row the second fourth bishop (20C), a fourth rook (20A) is initially positioned on a proximal square in the fourth proximal row adjacent the second fourth knight (20B).

FIGURE 3A

210

112 moving (212) the first rook (14A) from an initial square a number of spaces vertically or horizontally to a secondary square, capturing an opponent's piece if located in the secondary square, 214 moving (214) the first knight (14B) from an initial square two squares vertically or horizontally then perpendicularly one additional square to a secondary square, jumping intermediate game pieces if present by the left knight (16A), capturing an opponent piece if located in the secondary square, 216 moving (216) the first bishop (14C) a number of squares diagonally from an initial square to a secondary square, capturing an opponent's piece if located in the secondary square, 218 moving (218) the first queen (14D) any number of squares vertically or horizontally or diagonally from an initial square to a secondary square, capturing and opponent piece if located in the secondary square, 220 moving (220) the first king (14E) one square vertically or horizontally or diagonally from an initial square to a secondary square, capturing an opponent's piece if located on the secondary square, 222 moving (222) the first pawn (14F) from an initial square to a secondary square in a move selected from a group consisting of the initial square one squareforward to the secondary square and from an initial square two squares forward to a secondary square, capturing an opponent's piece if located in the secondary square squares diagonally from the path of the first pawn (14F).

FIGURE 4

310

312 moving (312) the second rook (16A) from an initial square a number of spaces vertically or horizontally to a secondary square, capturing an opponent's piece if located in the secondary square, 314 moving (314) the second knight (16B) from an initial square two squares vertically or horizontally then perpendicularly one additional square to a secondary square, jumping intermediate game pieces if present by the left knight (16A), capturing an opponent piece if located in the secondary square, 316 moving (316) the second bishop (16C) a number of squares diagonally from an initial square to a secondary square, capturing an opponent's piece if located in the secondary square, 318 moving (318) the second queen (16D) any number of squares vertically or horizontally or diagonally from an initial square to a secondary square, capturing and opponent piece if located in the secondary square, 320 moving (320) the second king (16E) one square vertically or horizontally or diagonally from an initial square to a secondary square, capturing an opponent's piece if located on the secondary square, 322 moving (322) the second pawn (16F) from an initial square to a secondary square in a move selected from a group consisting of the initial square one squareforward to the secondary square and from an initial square two squares forward to a secondary square, capturing an opponent's piece if located in the secondary square squares diagonally from the path of the second pawn (16F).

FIGURE 5

410

412 moving (412) the third rook (18A) from an initial square a number of spaces vertically or horizontally to a third square, capturing an opponent's piece if located in the third square, 414 moving (414) the third knight (18B) from an initial square two squares vertically or horizontally then perpendicularly one additional square to a third square, jumping intermediate game pieces if present by the left knight (18A), capturing an opponent piece if located in the third square, 416 moving (416) the third bishop (18C) a number of squares diagonally from an initial square to a third any square, capturing an opponent's piece if located in the third square, 418 moving (418) the third queen (18D) any number of squares vertically or horizontally or diagonally from an initial square to a third square, capturing and opponent piece if located in the third square, 420 moving (420) the third king (18E) one square vertically or horizontally or diagonally from an initial square to a third square, capturing an opponent's piece if located on the third square, 422 moving (422) the third pawn (18F) from an initial square to a third square in a move selected from a group consisting of the initial square one square forward to the third square and from an initial square two squares forward to a third square, capturing an opponent's piece if located in the third square squares diagonally from the path of the third pawn (18F).

FIGURE 6

510

512 moving (512) the fourth rook (20A) from an initial square a number of spaces vertically or horizontally to a secondary square, capturing an opponent's piece if located in the secondary square, 514 moving (514) the fourth knight (20B) from an initial square two squares vertically or horizontally then perpendicularly one additional square to a secondary square, jumping intermediate game pieces if present by the left knight (20A), capturing an opponent piece if located in the secondary square, 516 moving (516) the fourth bishop (20C) a number of squares diagonally from an initial square to a secondary square, capturing an opponent's piece if located in the secondary square, 518 moving (518) the fourth queen (20D) any number of squares vertically or horizontally or diagonally from an initial square to a secondary square, capturing and opponent piece if located in the secondary square, 520 moving (520) the fourth king (20E) one square vertically or horizontally or diagonally from an initial square to a secondary square, capturing an opponent's piece if located on the secondary square, and 522 moving (522) the fourth pawn (20F) from an initial square to a secondary square in a move selected from a group consisting of the initial square one squareforward to the secondary square and from an initial square two squares forward to a secondary square, capturing an opponent's piece if located in the secondary square squares diagonally from the path of the fourth pawn (20F).

FIGURE 7

FOUR WAY CHESS GAME

BACKGROUND OF THE INVENTION

1. Field of the Invention

The present invention relates to board games. More particularly, the present invention relates to the board game of chess having up two four players.

2. Description of the Prior Art

The standard game of chess is well known and played world wide. All of the potential moves have been documented and given time one can find the best counter move for any scenario presented by an opponent. The moves and counter moves are so well known that computers have been patented that can play the game against humans or against another computer. Many players study these materials and find that the excitement of the game is somewhat dulled.

The standard game of chess is played on a square game board divided into an eight by eight grid of squares alternately colored, typically white and black or red and black. Two sets of games pieces are arranged on opposite sides of the game board. The 'high value' pieced are arranged on the row furthest from the opponent. The lowest value piece, the pawn, is arranged in row directly in front of the latter. The objective is to place the opponents king in a condition which is formed by positioning the high value pieces such that the opponents king cannot move with out violating the high value pieces territory.

A need exists to expand upon the basic proven game of chess to provide more of a challenge to the players. This is accomplished by expanding the game board to a 10×10 central grid with appendages added to each side. Each appendage comprises a set of game pieces. When this expanded game is provided, the complexity and number of moves increases providing a more complex game to the individuals.

Numerous innovations for Modified Chess Game have been provided in the prior art that are described as follows. Even though these innovations may be suitable for the specific individual purposes to which they address, they differ from the present invention as hereinafter contrasted.

In U.S. Pat. No. 5,492,332, titled Chess-Type Game, invented by Joseph D. Hessnice, this invention is a chess-type board game apparatus and method of playing the same with a modified chess board having a main rectangular playing field and a generally pentagonal shaped field extending from one side thereof. The playing field as a whole comprises one-hundred eighteen identifiable squares of alternating color arranged in fourteen rank and eleven file rows and being divided into identical right and left halves about a center file row. Ten of the squares function as barriers which are strategically placed and are not available for occupancy by a playing piece. The playing field includes a throne square which imparts enhanced movement capabilities to playing pieces. The game is played by two opponents, each using ten playing pieces corresponding to the queen, knight, rook, and bishop of the conventional game of chess, each of the two sets of playing pieces being positioned at predetermined locations occupying the outer rank and file rows contained in the main rectangular field at the commencement of a game.

In U.S. Pat. No. 5,306,017, titled Civil War Chess, invented by James A. Huston, the invention is a game of tactics and strategy, played on a special ten-square by ten-square checkered board of 100 alternately colored squares, with twenty pieces likened to figures of the American Civil War, on each of two opposing sides. Twenty Civil War playing pieces are allotted to each opposing player. While many of those pieces have traditional chess-type playing moves and capture strategy, some of the pieces, such as a gunboat on each side, have particularly unique moves that have no parallel in conventional chess. For example, a gunboat may not enter a thirty-six square restricted zone located at the interior of the board. A gunboat may, however, capture pieces within this restricted zone. Players, including the President, may board the gunboat, and with the President aboard the gunboat's moveability is the combination of the gunboat and the President's normal moves. With other players aboard, the gunboat's moves are simply its own; and, thus, the boarded gunboat does not have a combination of movement as it does when the President is aboard.

In U.S. Pat. No. 5,193,813, titled Method of Playing Three-Dimensional Cubic Chess, invented by Allan Goff, three-dimensional chess played on a cubic playing field where moves are executed in cubic planes, and up to one-thousand playing positions are available. Ten boards are mounted over each other, each board defining a ten by ten matrix of one-hundred squares. The game is played by two opponents, each having a king, queen, two knights, two bishops, two rooks, two dukes, and ten pawns, the introduction of a duke being required for true three-dimensional movement of the playing pieces. Playing pieces move in reference to advancement squares, each piece having a defined planar movement pattern. Play on an eight by eight by eight or on an eight by eight by ten playing field configurations is possible by permitting the duke to occupy the same square as the bishop.

In U.S. Pat. No. 5,125,666, titled Four-Player Chess, invented by Timothy J. Adams, the invented four-player chess game includes a plurality of distinguishable sets of playing pieces including pieces equivalent to pawns, rooks, knights, bishops, queens and kings. It also includes a board having a main playing area made from a square matrix of eighty-by-eight alternately colored playing spaces with two additional rows of eight alternately colored playing spaces adjacent each side of the main playing area. The game is played by placing each player's set of playing pieces on the game board so that each different set occupies two conventional chess arrangements. Each player moves, in turn, one of his playing pieces anywhere on the game board according to standard chess rules, except the pieces equivalent to pawns may move up to three spaces forward on each of those pieces'initial move. Playing pieces are captured according to standard chess rules, except the pieces equivalent to pawns initially located at the ends of the first additional rows of alternately colored playing spaces adjacent the main playing area may not move diagonally to capture another piece equivalent to a pawn that has not moved. When more than two players are playing and remain in the game, players are eliminated when their king is captured and actually removed from the board, at which time all the remaining playing pieces in the set of the removed king are taken off the board. Play continues until only two players remain, at which time the game ends when one player checkmates the other player's king or when neither player can checkmate the other player's king.

In U.S. Pat. No. 4,708,349, titled Chess for Play by Two, Three or Four Persons, invented by Dan Shomer, a chess game is provided for play by two, three or four persons played according to the conventional rules of chess as to movement and capturing of pieces, castling, check and checkmate. As in conventional chess, each player possesses an initial force of a king, a queen, two bishops, two knights, two rooks and eight pawns. The game is played on a checkerboard having two hundred eight playing squares arranged in a central playing array of twelve bilaterally arranged rows having twelve squares per row and bordered by four smaller staging arrays, each of the staging arrays having eight bilaterally arranged rows of two squares per row. One of each of the four staging arrays is longitudinally centered on and contiguous with each of the four sides of the central playing array. Two of the four staging arrays have squares of different colors from each other. The players may play as individuals, or they may play as partners, including two playing as partners against a third or four playing as two sets of partners against one another.

Numerous innovations for Four Way Chess Game have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a highly intellectual game played by up to four players. The player may play against each other or in combination. The game consists of a standard set of chess game pieces controlled by standard chess rules. The standard chess game board is made wider by two rows and columes and 3×8 square appendages are added to each edge. The present invention is a clever adaptation of the standard rules of chess in conjunction with a new game board and novel rules for playing the new game.

The types of problems encountered in the prior art are that entire new games are disclosed with new rules and game pieces resulting in new rules and strategies needing to be developed. A player cannot use the experience he has gained over the years playing chess.

In the prior art, unsuccessful attempts to solve this problem were attempted namely: creating an entirely new game with new rules. However, the problem was solved by the present invention because the rules of the standard game of chess apply.

The present invention solved a long felt need for a new level of complexity to challenge the advanced chess players.

The present invention produced unexpected results namely a new and interesting adaptation of an well established game that is easy to learn yet is complex enough the challenge advanced minds.

Accordingly, it is an object of the present invention to provide a more interesting game with additional of columns, rows and appendages to the game board.

More particularly, it is an object of the present invention to provide increased complexity with the addition of up to two more players.

In keeping with these objects, and with others which will become apparent hereinafter, one feature of the present invention resides, briefly stated, in a new game board and two additional players.

Another object of the present invention to provide team play having up to four player compete in teams of two.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—modified chess game (10)
12—game board (12)
12A—first appendage (12A)
12B—second appendage (12B)
12C—third appendage (12C)
12D—fourth appendage (12D)
12E—center board (12E)
14—first set of game pieces (14)
14A—first rook (14A)
14B—first knight (14B)
14C—first bishop (14C)
14D—first queen (14D)
14E—first king (14E)
14F—first pawn (14F)
16—second set of game pieces (16)
16A—second rook (16A)
16B—second knight (16B)
16C—second bishop (16C)
16D—second queen (16D)
16E—second king (16E)
16F—second pawn (16F)
18—third set of game pieces (18)
18A—third rook (18A)
18B—third knight (18B)
18C—third bishop (18C)
18D—third queen (18D)
18E—third king (18E)
18F—third pawn (18F)
20—fourth set of game pieces (20)
20A—fourth rook (20A)
20B—fourth knight (20B)
20C—fourth bishop (20C)
20D—fourth queen (20D)
20E—fourth king (20E)
20F—fourth pawn (20F)
26—game board (26)

BRIEF DESCRIPTION OF THE PREFERRED EMBODIMENT

FIG. 3 and FIG. 3A show a method (110) of playing a modified chess game (10).

FIG. 4 show a method (210) of moving one game piece of the first set of game pieces.

FIG. 5 show a method (310) of using the second set of game pieces.

FIG. 6 show a method (410) of using the third set of game pieces.

FIG. 7 show a method (510) of using the fourth set of game pieces.

DETAILED DESCRIPTION OF THE PREFERRED EMBODIMENT

Figure 1:
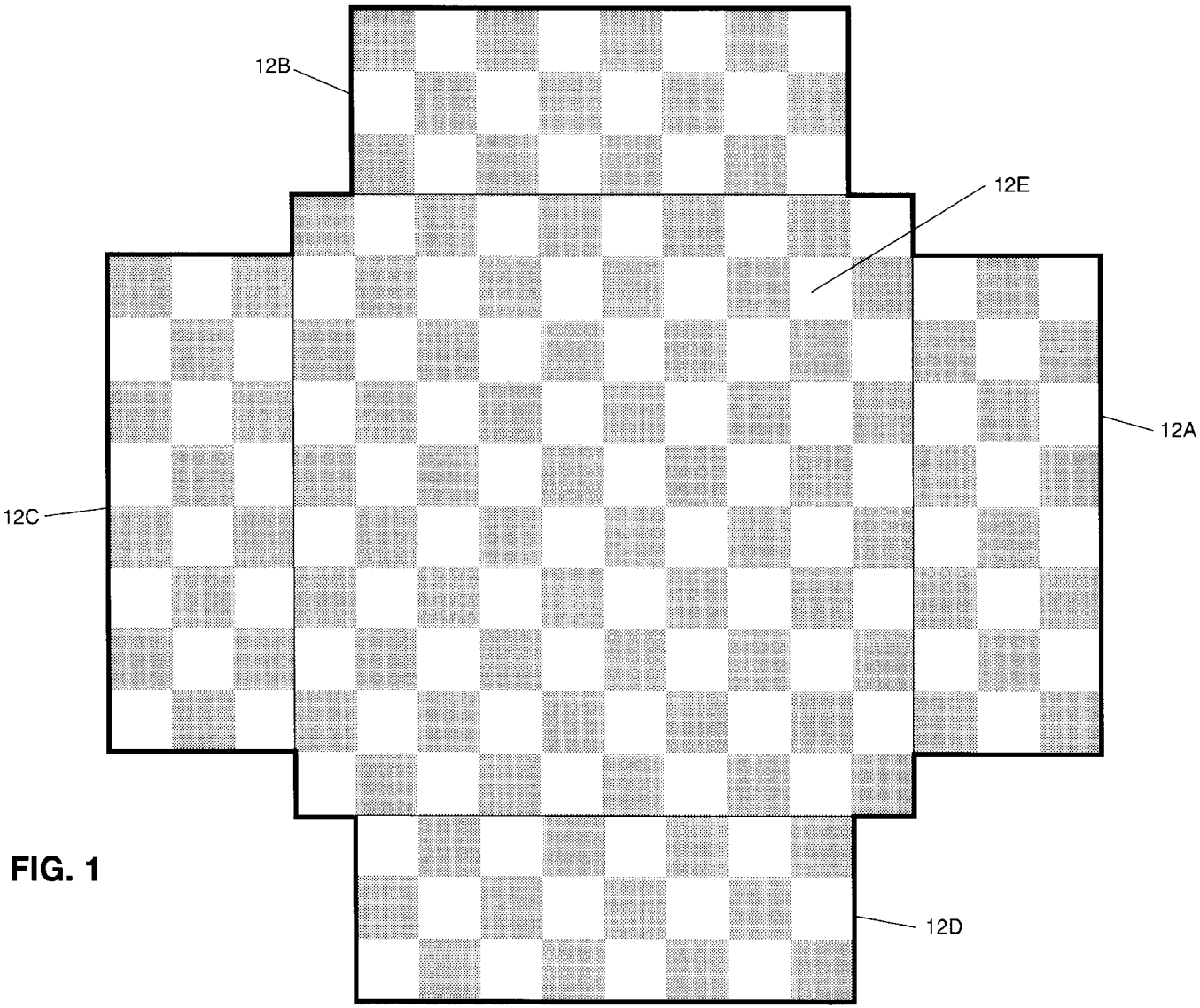
FIG. 1 is a top view of a modified chess game (10) showing the old and new pieces.

Firstly, referring to FIG. 1 which is a top view of a modified chess game (10) comprising the game board (12) which comprises a center board (12E) having ten vertical columns and ten horizontal rows having mutual intersections therebetween. The mutual intersections define alternating colored squares of play. Four appendages comprising a first appendage (12A), second appendage (12B), third appendage (12C), and fourth appendage (12D) each of three rows and eight columns are attached to each edge of the center board (12E). The appendages centered thereto having mutual intersections therebetween defining alternating colored squares of play. The squares of play are defined by contrasting colors.

The game board (12) is made from a material selected from a group consisting of marble, plastic, composites, metal, metal alloy, animal skins, cloth, ceramic, paper, cardboard, vinyl, Formica, woven pile, stone, and wood.

Figure 2:
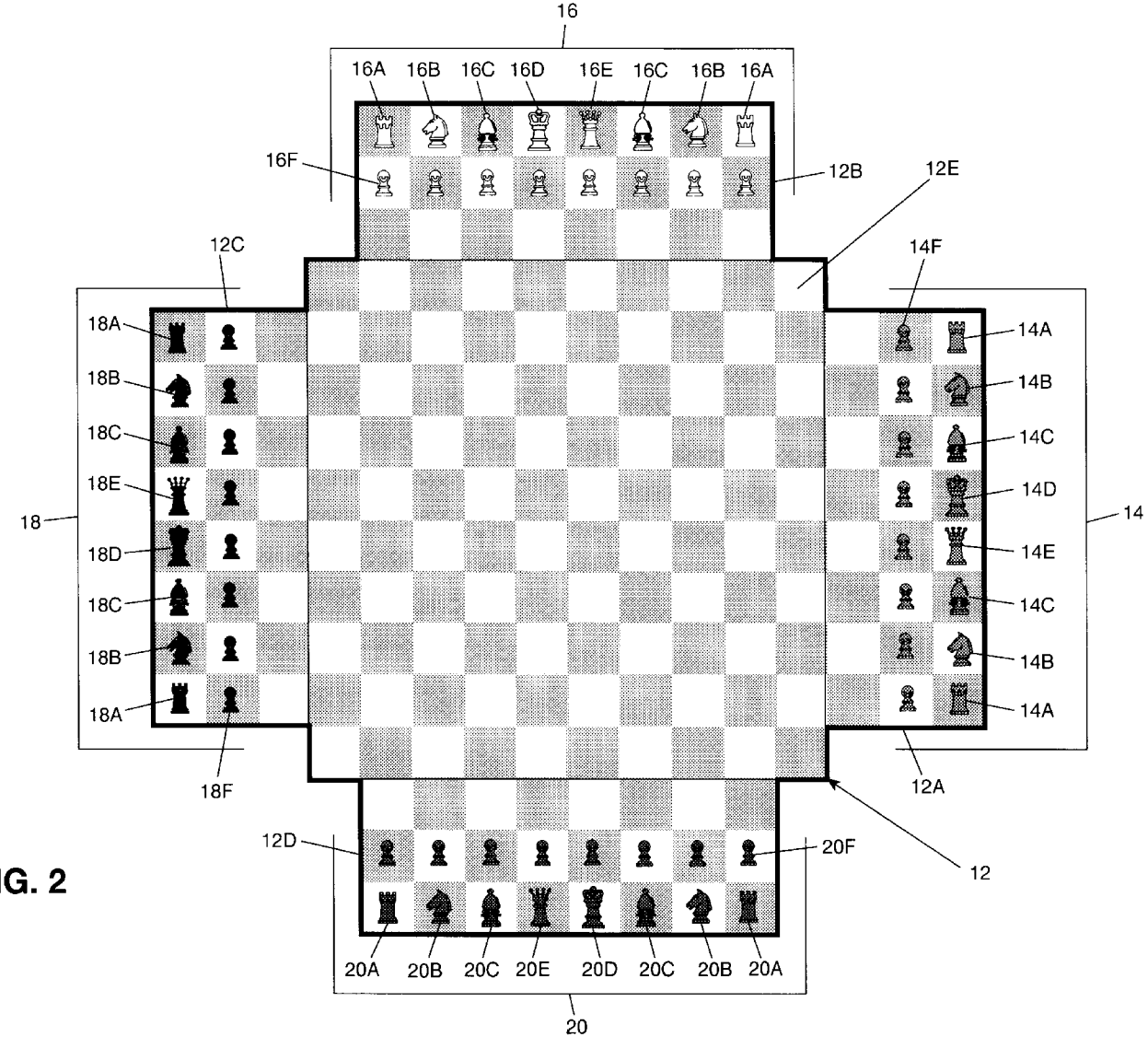
FIG. 2 is a top view of the modified chess game (10) showing the game pieces.

Secondly, referring to FIG. 2 which is a top view of a game board showing the additional columns, rows, appendages and game pieces. A first set of game pieces (14) are used by the first player. The first set of game pieces (14) have an identification means. The identification means is a contrasting color. The first set of game pieces (14) are arranged on a first appendage (12A) of the game board (12) proximal to the first player. The first set of game pieces (14) consists of ten first pawns (14F). The ten first pawns (14F) are initially positioned on a second proximal row of the first appendage (12A). The ten first pawns (14F) are positioned one first pawn (14F) per square. A first rook (14A) is initially positioned on a left proximal square in the first proximal row and first proximal column. A first knight (14B) is initially positioned on a proximal square in the first proximal row adjacent the first rook (14A). A first bishop (14C) is initially positioned on a proximal square in the first proximal row adjacent the first knight (14B). A first queen (14D) is initially positioned on a proximal square in the first proximal row adjacent the first bishop (14C). A first king (14E) initially positioned on a proximal square in the first proximal row adjacent the first queen (14D). A second first bishop (14C) is initially positioned on a proximal square in the first proximal row adjacent the first king (14E). A first knight (14B) is initially positioned on a proximal square in the first proximal row the second first bishop (14C). A left rook (14A) is initially positioned on a proximal square in the first proximal row adjacent the second first knight (14B).This completes the setup of the first set of game pieces (14).

A second set of game pieces (16) are used by a second player. The second set of game pieces (16) has an identification means. The identification means is a contrasting color. The second set of game pieces (16) are arranged on a second appendage (12B) of the game board (12) proximal to the second player. The second set of game pieces (16) consists of ten second pawn (16F) initially positioned on a second proximal row of the second appendage (12B). The second pawn (16F) are positioned one second pawn (16F) per square. A second rook (16A) is initially positioned on a left proximal square in the second proximal row and second proximal column. A second knight (16B) is initially positioned on a proximal square in the second proximal row adjacent the second rook (16A). A second bishop (16C) is initially positioned on a proximal square in the second proximal row adjacent the second knight (16B). A second queen (16D) is initially positioned on a proximal square in the second proximal row adjacent the second bishop (16C). A second king (16E) initially positioned on a proximal square in the second proximal row adjacent the second queen (16D). A second bishop (16C) is initially positioned on a proximal square in the second proximal row adjacent the second king (16E). A second knight (16B) is initially positioned on a proximal square in the second proximal row the second bishop (16C). A second rook (16A) is initially positioned on a proximal square in the second proximal row adjacent the second knight (16B).

A third set of game pieces (18) are used by a third player. The third set of game pieces (18) has an identification means. The identification means is a contrasting color. The third set of game pieces (18) are arranged on a s third appendage (12C) of the game board (12) proximal to the third player. The third set of game pieces (18) consists of ten third pawn (18F) initially positioned on a third proximal row of the third appendage (12C). Ten third pawns (18F) are positioned one third pawn (18F) per square. A third rook (18A) is initially positioned on a left proximal square in the third proximal row and third proximal column. A third knight (18B) is initially positioned on a proximal square in the third proximal row adjacent the third rook (18A). A third bishop (18C) is initially positioned on a proximal square in the third proximal row adjacent the third knight (18B). A third queen (18D) is initially positioned on a proximal square in the third proximal row adjacent the third bishop (18C). A third king (18E) initially positioned on a proximal square in the third proximal row adjacent the third queen (18D). A second third bishop (18C) is initially positioned on a proximal square in the third proximal row adjacent the third king (18E). A third knight (18B) is initially positioned on a proximal square in the third proximal row the second third bishop (18C). A third rook (18A) is initially positioned on a proximal square in the third proximal row adjacent the second third knight (18B).

A fourth set of game pieces (20) are used by a fourth player. The fourth set of game pieces (20) has an identification means. The identification means is a contrasting color. The fourth set of game pieces (20) are arranged on a fourth appendage (12D) of the game board (12) proximal to the fourth player. The fourth set of game pieces (20) consist of ten fourth pawns (20F). The fourth pawns (20F) are initially positioned on a fourth proximal row of the fourth appendage (12D). The fourth pawns (20F) are positioned one fourth pawn (20F) per square. A fourth rook (20A) is initially positioned on a left proximal square in the fourth proximal row and fourth proximal column. A fourth knight (20B) is initially positioned on a proximal square in the fourth proximal row adjacent the fourth rook (20A). A fourth bishop (20C) is initially positioned on a proximal square in the fourth proximal row adjacent the fourth knight (20B). A fourth queen (20D) is initially positioned on a proximal square in the fourth proximal row adjacent the fourth bishop (20C). A fourth king (20E) initially positioned on a proximal square in the fourth proximal row adjacent the fourth queen (20D). A second fourth bishop (20C) is initially positioned on a proximal square in the fourth proximal row adjacent the fourth king (20E). A fourth knight (20B) is initially positioned on a proximal square in the fourth proximal row the second fourth bishop (20C). A fourth rook (20A) is initially positioned on a proximal square in the fourth proximal row adjacent the second fourth knight (20B).

In an alternative method of play a first player and a second player form a team to oppose a third player and a fourth player forming a second team.

The first set of game pieces (14), second set of game pieces (16), third set of game pieces (18) and fourth set of game pieces (20) are manufactured from a material selected from a group consisting of marble, plastic, composites, metal, metal alloy, ceramic, paper, cardboard, vinyl, stone, and wood.

Thirdly, referring to FIG. 3 and FIG. 3A which show a method (110) of playing a modified chess game (10) comprising the game board (12). The method (110) of playing a modified chess game (10) consists of the steps of:

A) alternating turns (112) by at least two players selected from a group consisting of first player, second player, third player, and fourth player, each player having a corresponding set of game pieces;

B) first using (114) a first set of game pieces by the first player, the first set of game pieces having an identification means, the first set of game pieces are arranged on a first appendage (12A) of the game board (12) proximal to the first player, the first set of game pieces consisting of ten first pawns (14F), initially positioned on a second proximal row of the first appendage (12A), positioning one first pawn (14F) per square, a first rook (14A) is initially positioned on a left proximal square in the first proximal row and first proximal column, a first knight (14B) is initially positioned on a proximal square in the first proximal row adjacent the first rook (14A), a first bishop (14C) is initially positioned on a proximal square in the first proximal row adjacent the first knight (14B), a first queen (14D) is initially positioned on a proximal square in the first proximal row adjacent the first bishop (14C), a first king (14E) initially positioned on a proximal square in the first proximal row adjacent the first queen (14D), a second first bishop (14C) is initially positioned on a proximal square in the first proximal row adjacent the first king (14E), a first knight (14B) is initially positioned on a proximal square in the first proximal row the second first bishop (14C), a left rook (14A) is initially positioned on a proximal square in the first proximal row adjacent the second first knight (14B);

C) second using (114) a second set of game pieces (16) by a second player, the second set of game pieces (16) having an identification means, the second set of game pieces (16) are arranged on a second appendage (12B) of the game board (12) proximal to the second player consisting often second pawn (16F) initially positioned on a second proximal row of the second appendage (12B), positioning one second pawn (16F) per square, a second rook (16A) is initially positioned on a left proximal square in the second proximal row and second proximal column, a second knight (16B) is initially positioned on a proximal square in the second proximal row adjacent the second rook (16A),a second bishop (16C) is initially positioned on a proximal square in the second proximal row adjacent the second knight (16B), a second queen (16D) is initially positioned on a proximal square in the second proximal row adjacent the second bishop (16C), a second king (16E) initially positioned on a proximal square in the second proximal row adjacent the second queen (16D), a second bishop (16C) is initially positioned on a proximal square in the second proximal row adjacent the second king (16E), a second knight (16B) is initially positioned on a proximal square in the second proximal row the second bishop (16C), a second rook (16A) is initially positioned on a proximal square in the second proximal row adjacent the second knight (16B);

D) third using (116) a third set of game pieces (18) by a third player, the third set of game pieces (18) having an identification means, the third set of game pieces (18) are arranged on a s third appendage (12C) of the game board (12) proximal to the third player consisting of ten third pawn (18F) initially positioned on a third proximal row of the third appendage (12C), positioning one third pawn (18F) per square, a third rook (18A) is initially positioned on a left proximal square in the third proximal row and third proximal column, a third knight (18B) is initially positioned on a proximal square in the third proximal row adjacent the third rook (18A), a third bishop (18C) is initially positioned on a proximal square in the third proximal row adjacent the third knight (18B), a third queen (18D) is initially positioned on a proximal square in the third proximal row adjacent the third bishop (18C), a third king (18E) initially positioned on a proximal square in the third proximal row adjacent the third queen (18D), a second third bishop (18C) is initially positioned on a proximal square in the third proximal row adjacent the third king (18E), a third knight (18B) is initially positioned on a proximal square in the third proximal row the second third bishop (18C), a third rook (18A) is initially positioned on a proximal square in the third proximal row adjacent the second third knight (18B); and E) fourth using (118) a fourth set of game pieces (20) by a third player, the fourth set of game pieces (20) having an identification means, the fourth set of game pieces (20) are arranged on a s fourth appendage (12D) of the game board (12) proximal to the fourth player consisting of ten fourth pawn (20F) initially positioned on a fourth proximal row of the fourth appendage (12D), positioning one fourth pawn (20F) per square, a fourth rook (20A) is initially positioned on a left proximal square in the fourth proximal row and fourth proximal column, a fourth knight (20B) is initially positioned on a proximal square in the fourth proximal row adjacent the fourth rook (20A), a fourth bishop (20C) is initially positioned on a proximal square in the fourth proximal row adjacent the fourth knight (20B), a fourth queen (20D) is initially positioned on a proximal square in the fourth proximal row adjacent the fourth bishop (20C), a fourth king (20E) initially positioned on a proximal square in the fourth proximal row adjacent the fourth queen (20D), a second fourth bishop (20C) is initially positioned on a proximal square in the fourth proximal row adjacent the fourth king (20E), a fourth knight (20B) is initially positioned on a proximal square in the fourth proximal row the second fourth bishop (20C), a fourth rook (20A) is initially positioned on a proximal square in the fourth proximal row adjacent the second fourth knight (20B).

Now, referring to FIG. 4 which shows a method (210) of moving one game piece of the first set of game pieces. The first player utilities the method (210) of moving one game piece of the first set of game pieces (14). The one game piece move is selected from a group of moves consisting of:

A) Moving (212) the first rook (14A) from an initial square a number of spaces vertically or horizontally to a secondary square. The first rook (14A) captures an opponent's piece if the opponent's piece is located in the secondary square.

B) Moving (214) the first knight (14B) from an initial square, two squares vertically or horizontally then perpendicularly one additional square to a secondary square. The first knight (14B) jumps intermediate game pieces if present. The left knight (16A) captures an opponent piece if the opponent piece is located in the secondary square.

C) Moving (216) the first bishop (14C) a number of squares diagonally from an initial square to a secondary square. The first bishop (14C) captures an opponent's piece if the opponent's piece is located in the secondary square.

D) Moving (218) the first queen (14D) any number of squares vertically or horizontally or diagonally from an initial square to a secondary square. The first queen (14D) captures an opponent piece if the opponent piece is located in the secondary square.

E) Moving (220) the first king (14E) one square vertically or horizontally or diagonally from an initial square to a secondary square. The first king (14E) captures an opponent's piece if the opponent's piece is located on the secondary square.

F) Moving (222) the first pawn (14F) from an initial square to a secondary square in a move selected from a group consisting of the initial square one square forward to the secondary square and from an initial square two squares forward to a secondary square. The first pawn (14F) captures an opponent's piece if the opponent's piece is located in the secondary square squares diagonally from the path of the first pawn (14F).

Further, referring to FIG. 5 which shows a method (310) of using the s second set of game pieces (16) consisting one of the following steps selected from a group consisting of:

A) Moving (312) the second rook (16A) from an initial square a number of spaces vertically or horizontally to a secondary square. The second rook (16A) captures an opponent's piece if the opponent's piece is located in the secondary square.

B) Moving (314) the second knight (16B) from an initial square two squares vertically or horizontally then perpendicularly one additional square to a secondary square. The second knight (16B) jumps intermediate game pieces if present. The second knight (16B) captures an opponent's piece if the opponent's piece is located in the secondary square.

C) Moving (316) the second bishop (16C) a number of squares diagonally from an initial square to a secondary square. The second bishop (16C) captures an opponent's piece if the opponent's piece is located in the secondary square.

D) Moving (318) the second queen (16D) any number of squares vertically or horizontally or diagonally from an initial square to a secondary square. The second queen (16D) captures an opponent's piece if the opponent's piece is located in the secondary square.

E) Moving (320) the second king (16E) one square vertically or horizontally or diagonally from an initial square to a secondary square. The second king (16E) captures an opponent's piece if the opponent's piece is located in the secondary square.

F) Moving (322) the second pawn (16F) from an initial square to a secondary square in a move selected from a group consisting of the initial square one square forward to the secondary square and from an initial square two squares forward to a secondary square. The second pawn (16F) captures an opponent's piece if the opponent's piece is located in the secondary square squares diagonally from the path of the second pawn (16F).

Now, referring to FIG. 6 which shows a method (410) of using the third set of game pieces (18) consisting of one of the following steps selected from a group consisting of:

A) Moving (412) the third rook (18A) from an initial square a number of spaces vertically or horizontally to a second square. The third rook (18A) captures an opponent's piece if the opponent's piece is located in the secondary square.

B) Moving (414) the third knight (18B) from an initial square two squares vertically or horizontally then perpendicularly one additional square to a second square. The third knight (18B) jumps intermediate game pieces if present. The third knight (18B) captures an opponent's piece if the opponent's piece is located in the secondary square.

C) Moving (416) the third bishop (18C) a number of squares diagonally from an initial square to a second any square. The third bishop (18C) captures an opponent's piece if the opponent's piece is located in the secondary square.

D) Moving (418) the third queen (18D) any number of squares vertically or horizontally or diagonally from an initial square to a second square. The third queen (18D) captures an opponent's piece if the opponent's piece is located in the secondary square.

E) Moving (420) the third king (18E) one square vertically or horizontally or diagonally from an initial square to a second square,. The third king (18E) captures an opponent's piece if the opponent's piece is located in the secondary square.

F) Moving (422) the third pawn (18F) from an initial square to a second square in a move selected from a group consisting of the initial square one square forward to the second square and from an initial square two squares forward to a second square. The third pawn (18F) captures an opponent's piece if the opponent's piece is located in a third square diagonally from the path of the third pawn (18F).

Now, referring to FIG. 7 which shows a method (510) of using the fourth set of game pieces (20) consists of one of the following steps selected from a group consisting of:

A) Moving (512) the fourth rook (20A) from an initial square a number of spaces vertically or horizontally to a secondary square. The fourth rook (20A) captures an opponent's piece if the opponent's piece is located in the secondary square.

B) Moving (514) the fourth knight (20B) from an initial square two squares vertically or horizontally then perpendicularly one additional square to a secondary square, jumping intermediate game pieces if present by the left knight (20A). The fourth knight (20B) captures an opponent's piece if the opponent's piece is located in the secondary square.

C) Moving (516) the fourth bishop (20C) a number of squares diagonally from an initial square to a secondary square. The fourth bishop (20C) captures an opponent's piece if the opponent's piece is located in the secondary square.

D) Moving (518) the fourth queen (20D) any number of squares vertically or horizontally or diagonally from an initial square to a secondary square. The fourth queen (20D) captures an opponent's piece if the opponent's piece is located in the secondary square.

E) Moving (520) the fourth king (20E) one square vertically or horizontally or diagonally from an initial square to a secondary square. The fourth king (20E) captures an opponent's piece if the opponent's piece is located in the secondary square.

F) Moving (522) the fourth pawn (20F) from an initial square to a secondary square in a move selected from a group consisting of the initial square one square forward to the secondary square and from an initial square two squares forward to a secondary square. The fourth pawn (20F) captures an opponent's piece if the opponent's piece is located in a third square diagonally from the path of the fourth pawn (20F).

It will be understood that each of the elements described above, or two or more together, may also find a useful application in other types of constructions differing from the type described above.

While the invention has been illustrated and described as embodied in a Four Way Chess Game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. In a method of playing a modified game of chess for three or four players, utilizing distinguishable sets of conventional chess pieces consisting of eight pawns, two rooks, two knights, two bishops, one king and one queen; a primary playing board having a square checkerboard array of squares extending in the "X" and "Y" directions, the improvement comprising in combination therewith, a primary playing board having an array of ten rows, and four extended playing areas, each said extended playing area consisting of three rows of eight alternately colored squares, comparable to said squares of said primary playing board, and appended to a different side of said primary playing board, where each extended playing area is provided with one of said sets arranged on the outer most two rows thereof, and sequentially moving the respective said sets according to the conventional playing moves for said chess pieces.

2. The method of playing the modified game of chess according to claim 1, wherein there are three players, and that opposing players play as partners against the third player.

3. The method of playing the modified game of chess according to claim 1, wherein there are four players.

4. The method of playing the modified game of chess according to claim 3, wherein opposing players each comprise a team.

* * * * *